United States Patent [19]

Klein et al.

[11] Patent Number: 4,666,413

[45] Date of Patent: May 19, 1987

[54] LIFE-SAVING APPLIANCE WITH A GAS-TIGHT COVERING

[75] Inventors: Gotthold Klein, Rellingen; Henning Peters, Seestermühe, both of Fed. Rep. of Germany

[73] Assignee: Autoflug GmbH, Fed. Rep. of Germany

[21] Appl. No.: 671,345

[22] Filed: Nov. 14, 1984

[30] Foreign Application Priority Data

Nov. 14, 1983 [DE] Fed. Rep. of Germany ..... 3341163

[51] Int. Cl.[4] ..... B63C 9/12

[52] U.S. Cl. ..... 441/92

[58] Field of Search ..... 114/366–367; 441/32, 42, 80; 244/148, 149; 206/524, 524.8

[56] References Cited

U.S. PATENT DOCUMENTS

| | | | |
|---|---|---|---|
| 3,557,518 | 1/1971 | Purkey | 206/524 |
| 3,584,815 | 6/1971 | Stencel | 244/149 |
| 3,712,568 | 1/1973 | Grasso et al. | 244/148 |
| 4,457,730 | 7/1984 | Foster et al. | 441/42 |

FOREIGN PATENT DOCUMENTS

| | | | |
|---|---|---|---|
| 1781204 | 10/1970 | Fed. Rep. of Germany | 114/366 |

*Primary Examiner*—Sherman D. Basinger
*Assistant Examiner*—Jesûs D. Sotelo
*Attorney, Agent, or Firm*—Handal & Morofsky

[57] ABSTRACT

The life-saving appliance (1) is arranged in a covering (5), which is evacuated. So that the covering (5) cannot be damaged, it is enclosed in a hard foam casing (6). Through openings (7, 8) the life-saving appliance (1) can be released from the casing with the help of a pull member (4), or the vacuum in the covering (5) can be tested by touching the latter.

8 Claims, 2 Drawing Figures

LIFE-SAVING APPLIANCE WITH A GAS-TIGHT COVERING

Figure 1:
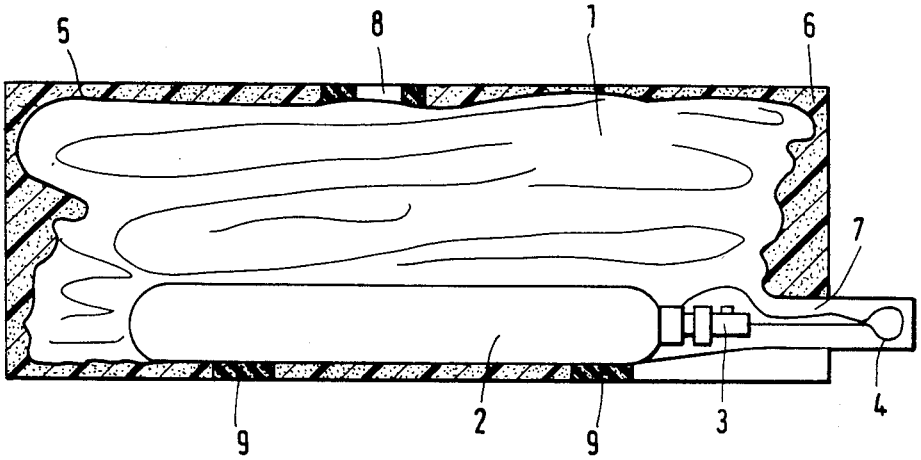

The invention relates to a life-saving appliance which is arranged in a gas-tight, flexible covering subjected to vacuum.

Life-saving appliances are usually stored in a gas-tight, flexible covering, which is subject to vacuum, because then they require much less space. Due to the vacuum, the life-saving appliance, for example a parachute or an inflatable life-saving appliance such as a life jacket, a life raft, a life-boat or the like, is compressed into a rigid and very compact package by the external pressure acting on the covering. The volume of the packed life-saving appliance can then be reduced down to one third of that volume which can be attained by careful packing without vacuum. Furthermore there is the advantage of the rigid packing that individual layers of the package, that is individual sheets of the folded-up life-saving appliance, cannot shift relatively to one another; rather, the vacuum-packed package is very stable in shape.

On the other hand, inflatable life-saving appliances, as for example life jackets, life rafts, life-boats and the like, are normally stored together with a compressed gas bottle, so that in case of need they can be quickly inflated by actuation of the valve of the compressed gas bottle. Of course it is then necessary to test at regular intervals, whether the device is still intact. So in one instance one should test whether pressure has escaped from the compressed gas bottle. On the other hand, one should test whether the life-saving appliance possibly exhibits a leak from external damage.

In order to reduce the volume of the package, to achieve a firm package, and to avoid troublesome regular testing procedures, it is known to provide the life-saving appliance together with the compressed air cylinder with a covering subject to vacuum, and to store it in that condition (German Patent Specification No. 3,036,796). As long as this covering still remains under vacuum, one can be certain that the life-saving appliance is not damaged, and also that the compressed gas bottle still contains gas. That is to say, if the life-saving appliance is damaged by an external sharp object, then the covering is damaged likewise, so that it loses its vacuum. If on the other hand compressed gas escapes from the compressed gas bottle, then vacuum can no longer exist in the covering. The absence of the vacuum can however be easily determined, in that the covering no longer encloses the life-saving appliance closely, but the package becomes limp and, according to the extent of the leak, sooner or later the covering hangs loosely from the package.

If the life-saving appliance is to be used, then one pulls on a pull member. In the case of the parachute, the covering is thereby torn at a breaking point, so that the covering fills with air, the parachute assumes a limply packed condition and thus can be drawn out of the covering. Of course this pulling out can also occur automatically, for example when dropping loads from aircraft. If an inflatable life-saving appliance is being used, then one actuates the valve of the compressed gas cylinder by means of a pull member, which can be gripped from outside the covering. When the life-saving appliance has been inflated, the covering thereupon bursts as a consequence of the pressure and so releases the life-saving appliance.

Normally the covering is a relatively thin plastic film. Consequently very careful handling is necessary for the package consisting of life-saving appliance and covering. If this package rubs against any object, or comes into contact with sharp edges, then the covering is damaged, so that the vacuum disappears and one is no longer certain whether the life-saving appliance is in reliable condition. This is particularly so because, as a result of the action of the vacuum, the covering has relatively sharp edges.

The object of the invention is to improve an appliance of the kind described initially, so that the covering is better protected against damage.

The solution according to the invention lies in that the covering is surrounded by a hard foam casing provided with an opening, which lies closely-fitting against the covering.

The whole package has in this way a rigid form. Any sharp edges or the like, against which the package bumps, can damage at most the outside of the hard foam casing, but not damage the covering. Also there is no danger that the covering will be damaged by rubbing of the package against any object.

If the hard foam casing is sufficiently rigid, the whole package, with life-saving appliance and covering, also has a correspondingly greater stability, so that damage to the life-saving appliance or covering due to bending of the package during transport or storage can be avoided. In this way it is possible for the first time to employ the principle of a covering subjected to vacuum even to larger life rafts and the like.

Since the hard foam casing is provided with an opening, the condition of the covering, and hence of the vacuum, can be tested at any time through this opening.

If the life-saving appliance is in particular a vacuum-packed parachute, this can be pulled out without any problem, as out of a previously known covering, if the covering and/or the hard foam casing are provided in the neighbourhood of the opening with one or more breaking points, and a pull member for releasing the life-saving appliance with simultaneous opening of the covering and/or hard foam casing is arranged in the region of the opening. The life-saving appliance can be pulled out of the package in exactly the same way as is the case with the previously known vacuum-packed life-saving appliances. There is thus no need for adaptation to the life-saving appliance according to the invention, nor any departure from the usual, or retraining of servicing and operating personnel. The hard foam casing then normally consists of a very easily frangible material, so that special breaking points in the hard foam casing are usually quite unnecessary. On the other hand the opening in the hard foam casing could also be made so large that the parachute can be drawn out here without difficulty, with-out destruction of the hard foam casing.

If, with an inflatable life-saving appliance such as a life jacket, a life raft, a life-boat or the like, which is arranged within the covering together with a compressed gas bottle, the valve of which can be opened from outside the covering for inflation of the life-saving appliance, provision is made that a pull member for actuation of the valve of the compressed gas bottle is arranged in the region of the opening, then the valve can be especially easily actuated; there is then no need to first tear away or destroy a portion of the hard foam casing. When the life-saving appliance is inflated after the actuation of the valve, then, from the excess pressure which arises, not only is the relatively thin covering destroyed, but also the hard foam casing is burst open, so that the life-saving appliance is freed.

If a portion of the covering projects out of the hard foam casing, together with the handle for actuating the valve, then one can test at this part of the covering whether the covering is still under vacuum.

If, however, a further opening is provided in the hard foam casing for testing the covering of the device then the covering, or the question whether it is still under vacuum, can be determined at a more or less flat area of the covering, where the question of gas-tightness can be tested better than at a place at which the covering is enclosed by a handle. Through this opening can also be visible, e.g., a humidity meter, which is arranged within the inner covering. If humidity is indicated here, then it is at once apparent that the vacuum is no longer there.

The hard foam casing can consist of a polyurethane foam. What has proved particularly advantageous is an open-pored and half-hard polyurethane foam, which is mixed from two components and reacts within about 90 seconds and fully hardens within three minutes.

A significant merit of the invention is that a casing has been found, in the form of the hard foam casing, which on the one hand safely protects the contents, and on the other hand bursts open of itself upon inflation of the life-saving appliance. Hitherto, people were of the opinion that these requirements could not be met simultaneously.

One could indeed improve the protection of the contents by a thicker covering foil; it would then however be uncertain whether this covering foil would also actually break up in the desired manner. Hitherto people were therefore compelled to store the package with the covering foil in a very expensive padded pocket for safe storage, which pocket must also be burst upon activation of the appliance. Along with the corresponding costs and the necessary additional opening forces for the pocket of the package, there also arises the problem that even in this way damage of the thin covering foil cannot be prevented with certainty.

The invention will be described below in relation to an advantageous embodiment, by way of example, with reference to the accompanying drawings.

Figure 2:
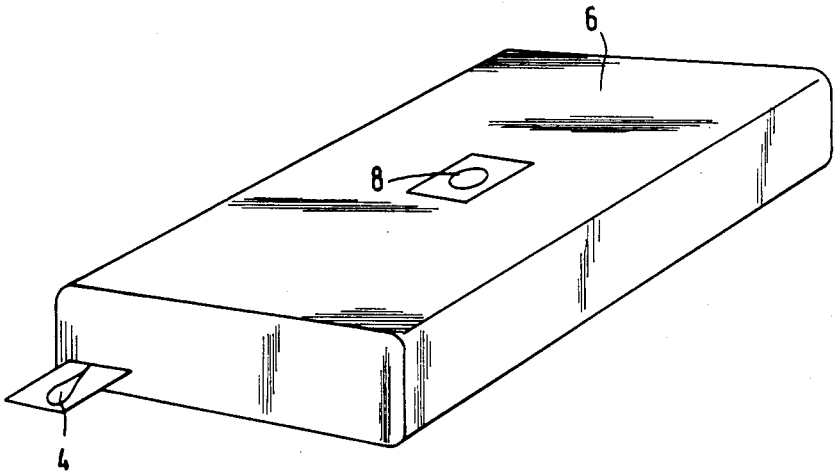

FIG. 1 shows a life-saving appliance according to the invention with covering and hard foam casing, in schematic view in cross section, and FIG. 2 shows a perspective view of the appliance of FIG. 1.

As can be seen from FIG. 1, the life raft 1, in folded condition, is connected with a compressed gas bottle 2 through a valve 3, which can be opened by actuation of a handle 4, so that the life raft 1 is inflated. The life raft and the compressed gas bottle are in a covering 5, e.g. a thin plastics foil, thoroughly and specially impermeable to gas, which is evacuated and which thus closely encloses the life raft 1 and the compressed gas bottle 2. Further, the flexible covering 5 is surrounded in a closely fitting manner by a hard foam casing 6. This hard foam casing has at 7 an opening, out of which projects a part of the covering 5 with the handle 4 for the valve 3 of the compressed gas bottle 2. In addition the hard foam casing 6 has a further opening 8, through which by touching the covering 5 one can test whether the covering is still under vacuum. Also a humidity meter can be fitted there within the covering, which indicates if moisture has penetrated into the covering 5 and this is therefore no longer under vacuum.

The device of FIG. 1 can be manufactured in such a way that after installation of the evacuated covering 5, the entire device is placed in a mould, on spacers 9 which can consist e.g. of foam material, and thereafter the space between the wall of the mould and the covering 5 is filled with foam. After the hardening of the foam, the device can then be removed from the mould and used.

We claim:

1. A device comprising:

(a) a flexible item;

(b) an air-tight flexible covering defining a container volume under vacuum, said volume under vacuum containing said flexible item;

(c) pressure means for introducing a fluid under pressure into said covering;

(d) trigger means for actuating said pressure means in response to an activating action;

(e) a frangible casing defining a casing volume, said casing volume containing said air-tight flexible covering, said frangible casing being configured and dimensioned to break apart upon the application of pressure from within said frangible casing, said pressure being caused by the introduction of fluid into said covering by activation of said trigger means and resultant physical expansion of said covering.

2. A device as in claim 1, wherein said casing is made of a hard foam material and further defines a first opening portion configured, dimensioned and positioned to allow the physical examination of said flexible covering to ascertain whether said vacuum exists.

3. A device as in claim 2, wherein said casing further defines a second opening portion configured, positioned and dimensioned to allow actuation of said trigger means.

4. A device as in claim 2, wherein said flexible item is a life saving appliance.

5. A device as in claim 4, wherein said casing is provided with a number of highly frangible breaking portions.

6. A device as in claim 5, wherein said breaking portions are located in the general location of said opening portions and said trigger means comprises a pull member which extends through a second opening portion in said casing.

7. A device as claimed in claim 6, wherein said item is an inflatable buoyant life saving device and is positioned within the container volume together with said pressure means which comprises a compressed gas bottle having a valve which can be opened from outside the covering.

8. A device as claimed in claim 1, wherein said casing consists of a polyurethane foam.

* * * * *